US008074737B2

(12) United States Patent
Hill et al.

(10) Patent No.: US 8,074,737 B2
(45) Date of Patent: Dec. 13, 2011

(54) WIRELESS PERFORATING GUN INITIATION

(75) Inventors: Freeman L. Hill, Houston, TX (US); Gary J. Cresswell, Spring, TX (US); David M. Chace, Houston, TX (US); Randy L. Evans, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/841,062

(22) Filed: Aug. 20, 2007

(65) Prior Publication Data

US 2009/0050322 A1 Feb. 26, 2009

(51) Int. Cl.
*E21B 43/116* (2006.01)
*F42D 3/00* (2006.01)

(52) U.S. Cl. ..... 175/4.55; 175/4.6; 166/298; 102/312

(58) Field of Classification Search ..... 166/55.1, 166/298; 175/4.55, 4.6; 102/312
See application file for complete search history.

(56) References Cited

U.S. PATENT DOCUMENTS

| | | | | |
|---|---|---|---|---|
| 3,010,396 | A * | 11/1961 | Coleman | 175/4.55 |
| 4,544,034 | A | 10/1985 | George | |
| 4,566,538 | A * | 1/1986 | Peterson | 166/278 |
| 4,836,109 | A | 6/1989 | Wesson et al. | |
| 6,536,524 | B1 * | 3/2003 | Snider | 166/297 |
| 6,557,636 | B2 * | 5/2003 | Cernocky et al. | 166/297 |
| 6,837,310 | B2 * | 1/2005 | Martin | 166/297 |
| 2002/0062991 | A1 * | 5/2002 | Farrant et al. | 175/4.55 |
| 2003/0000411 | A1 * | 1/2003 | Cernocky et al. | 102/200 |
| 2003/0213595 | A1 * | 11/2003 | Jackson | 166/297 |
| 2004/0206503 | A1 * | 10/2004 | Bell et al. | 166/297 |
| 2005/0045331 | A1 * | 3/2005 | Lerche et al. | 166/297 |
| 2006/0196665 | A1 * | 9/2006 | LaGrange et al. | 166/298 |
| 2009/0084535 | A1 * | 4/2009 | Bertoja et al. | 166/55.2 |

* cited by examiner

*Primary Examiner* — William P Neuder
*Assistant Examiner* — Catherine Loikith
(74) *Attorney, Agent, or Firm* — Bracewell & Giuliani, LLP

(57) ABSTRACT

A perforating system and method for wellbore perforating. The system comprises a perforating string having a perforating gun with shaped charges, a communication module for receiving detonation signals, and a controller associated with each perforating gun. The module receives surface signals for gun detonation and wirelessly transmits the signals to selected guns via the associated controllers.

31 Claims, 4 Drawing Sheets

WIRELESS PERFORATING GUN INITIATION

BACKGROUND OF THE INVENTION

1. Field of the Invention

The disclosure herein relates generally to the field of oil and gas production. More specifically, the present disclosure relates to a method and apparatus for initiating detonation of a perforating using wireless transmission.

2. Description of Related Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore. As is known, hydrocarbon-bearing strata, such as reservoirs, exist within these formations. The wellbores typically intersect these reservoirs.

Perforating systems are used for perforating through the cement and casing into the surrounding subterranean formation. These systems typically comprise one or more perforating guns strung together, these strings of guns can sometimes surpass a thousand feet of perforating length. Included with the perforating guns are shaped charges that typically include a charge case, a liner, and a quantity of high explosive inserted between the liner and the charge case. When the high explosive is detonated, the force of the detonation collapses the liner and ejects it from one end of the charge at very high velocity in a pattern called a "jet". The jet penetrates the casing, the cement and a quantity of the formation thereby forming a perforation in the formation that enables fluid communication between the wellbore and its surrounding formation.

FIG. 1 is a side partial cutaway view of a perforating system 5 comprising a perforating string 7 suspended within a wellbore 25. The perforating string 7 comprises a series of perforating guns 13 axially connected to one another by connecting subs 15. Tubing 9 is shown attached to the perforating string 7 and is a raising/lowering means for the perforating guns 13. The tubing 9 can also provide communication between the perforating string 7 and a surface truck 11. In some instances wireline is used in place of the tubing 9. The surface truck 11 typically includes a winch type device for disposal and retrieval of a perforating string 7 or instrument string in and out of the well. Also included within the surface truck 11 is an interface enabling surface personnel to transmit commands and receive data to and from the perforating string 7. The communicated data between the surface and the string 7 is generally provided along or by means of the tubing 9. The perforating string 7 of FIG. 1 is shown disposed in a deviated portion of the wellbore 25. For the purposes of illustration, perforations 21 are shown that extend from the wellbore 25, through the casing 17 that lines the wellbore 25, and into the surrounding formation 19.

The shaped charges are initiated by sending a signal from the surface to the perforating string 7 through the tubing 9. The signal is then received by a firing head 14 disposed on the upper portion of the perforating string 7. The firing head 14 transfers the firing signal to an initiator which then detonates an associated detonating cord. Typically the initiator is a type electrical blasting cap, an electrically-activated exploding bridge wire ("EBW") initiator, an electrically activated exploding-foil initiator ("EFI") or a percussively-activated explosive initiator. The explosive-filled tube is generally referred to as "detonating cord". A type of detonating cord known in the art is sold by the Ensign-Bickford Company under the trade name PRIMACORD®. A resulting detonation wave passes along the length of the detonating cord that in turn initiates detonation of the connected shaped charges.

FIG. 2 shows an example of a section of a perforating gun 13 being detonated within a wellbore 25. As shown, the perforating gun 13 includes shaped charges 16 having a connected detonation cord 18. Some of the shaped charges 16 have been detonated thereby producing perforations 21 extending into the corresponding formation 19. A portion of the detonating cord 18 is missing proximate to the shaped charges having already been detonated demonstrating how the cord has been consumed by the detonating pressure wave. Thus, it is illustrated how the sequential detonation of adjacent shaped charges takes place in a particular perforating gun producing perforations extending through a casing 17 and to the corresponding formation 19.

BRIEF SUMMARY OF THE INVENTION

A method of perforating a wellbore comprising disposing a perforating system in a wellbore on a conveyance member, wherein the perforating system comprises a perforating gun, a receiver and/or transmitter, and a communication module. The method also includes transmitting a detonation signal to the communication module, wherein the communication module is configured to transmit a corresponding wireless detonation signal to the controller and wherein the controller is configured to initiate detonation of the perforating gun in response to receiving a detonation signal from the communication module. The detonation signal may be transmitted from the surface through the conveyance member. The perforating gun detonation may be initiated by a pressure source, optionally the pressure source may be from wellbore pressure. Perforating gun detonation may occur by introducing wellbore pressure communication to an initiating system associated with the perforating gun. A selectable open and closed control valve may be used for communicating the wellbore fluid to the perforating gun initiator. The perforating system may further comprise many perforating gun with associated controllers. Thus the method may include selectively sending signals from the communication module to selected controllers thereby selectively detonating a particular perforating gun, or a particular collection of perforating guns. The wireless signal may be a mud pulse, a radio signal, a high frequency signal along the perforating system, a low frequency signal along the perforating system or combinations thereof.

The present disclosure also includes a perforating system disposable in a wellbore comprising, a perforating gun, a communication module configured to receive commands from the surface while disposed within a wellbore, and a perforating gun controller in selective communication with the communication module. The perforating gun controller is configured to initiate perforating gun detonation in response to communication from the communication module. Optionally, the perforating gun controller comprises a controller module and a receiver and perhaps a transmitter for two way communication of data and logic. The perforating system can further comprise a perforating gun initiator, optionally the initiator is responsive to commands from the perforating gun controller and may be pressure actuated. A control valve may be employed for producing initiating that is actuatable by the controller and in pressure communication with the wellbore and the initiator. The control valve may also selectively communicate wellbore pressure to the initiator. The communication module may optionally be configured to emit signals, where the signals may be one or a combination of a mud pulse signal, a radio signal, a high frequency signal and a low frequency signal. The perforating system may further comprise a conveyance member, the conveyance member may be wireline, tubing, coiled tubing, slickline, tractor, or combinations there of.

DETAILED DESCRIPTION OF THE INVENTION

The device and system disclosed herein comprises a perforating system configured to initiate perforating gun detonation by transmitting wireless signals from a portion of the perforating string selectively to individual perforating guns or sets of perforating guns. The perforating string is configured to receive command data from the wellbore surface while the string is disposed within a wellbore. A module within the system may receive the surface commands, process the signal received, and send a corresponding signal to initiate perforating gun detonation. Each gun, or set of guns, will have an associated receiver or receiver/transmitter and controller for receiving the signal from the module and activating perforating gun initiation. Optionally, a transmitter can be included in association with the receiver. Perforating gun initiation may be through pressure from the wellbore communicated to an initiator or an electrical initiator. In one embodiment of pressure actuation, the receiver/controller for each perforating gun selectively opens a valve or port allowing pressure communication between a wellbore and the initiator. Introducing pressure to the initiator in turn activates the initiator for detonating shaped charges with the associated perforating gun (or sets of perforating guns).

Figure 1:
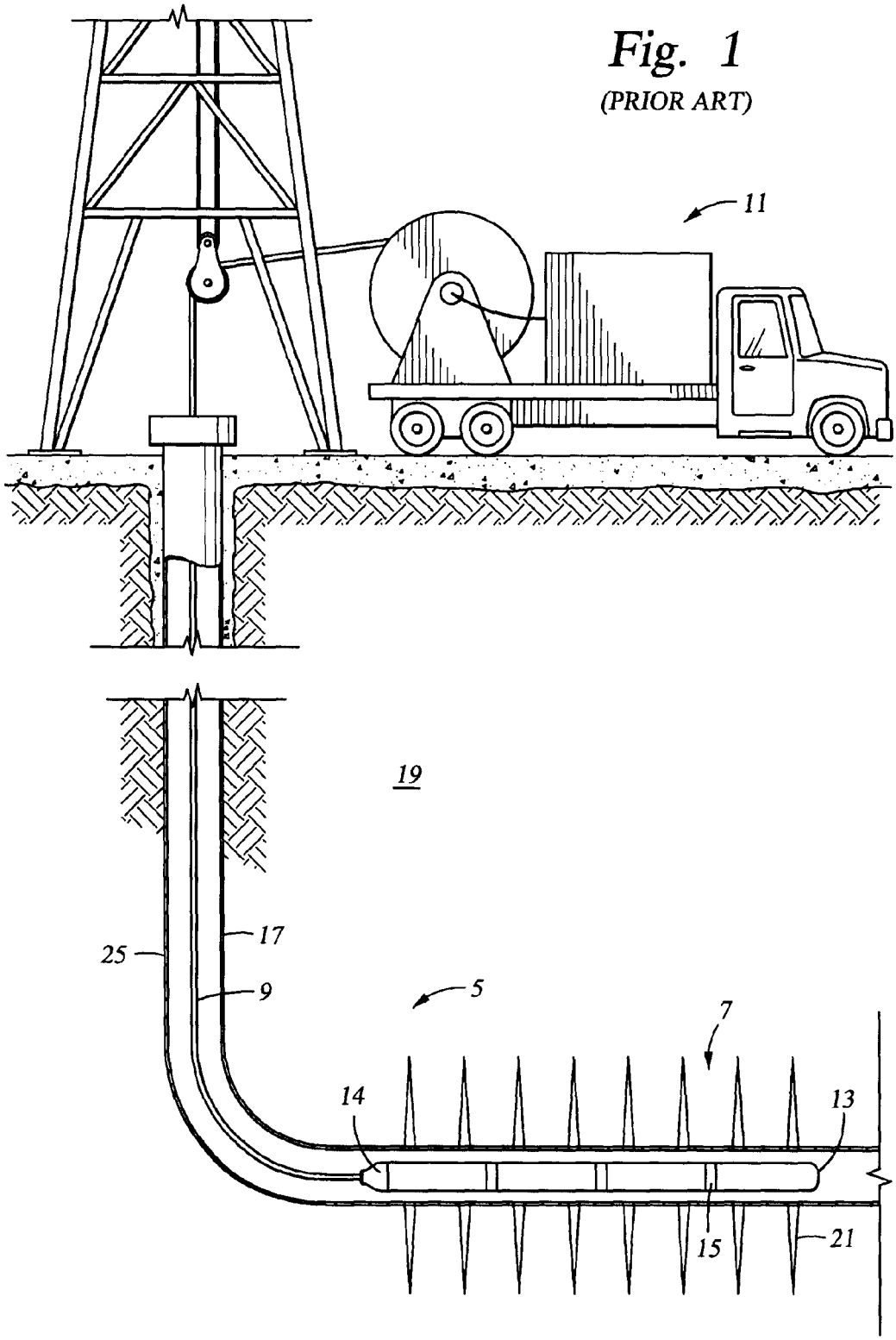
Fig. 1 (PRIOR ART)
FIG. 1 depicts a perforating operation in a side partial cut-away view.
Figure 2:
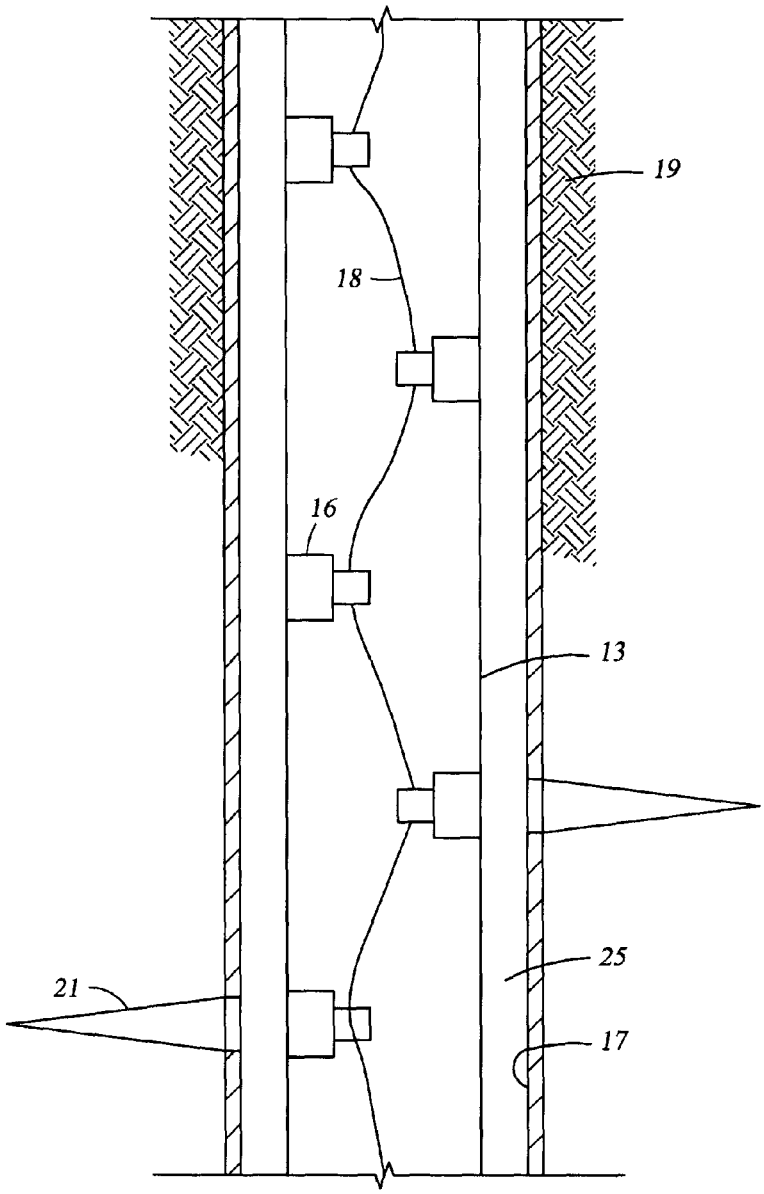
Fig. 2 (PRIOR ART)
FIG. 2 illustrates a side cutaway view of shaped charge detonation.
Figure 3:
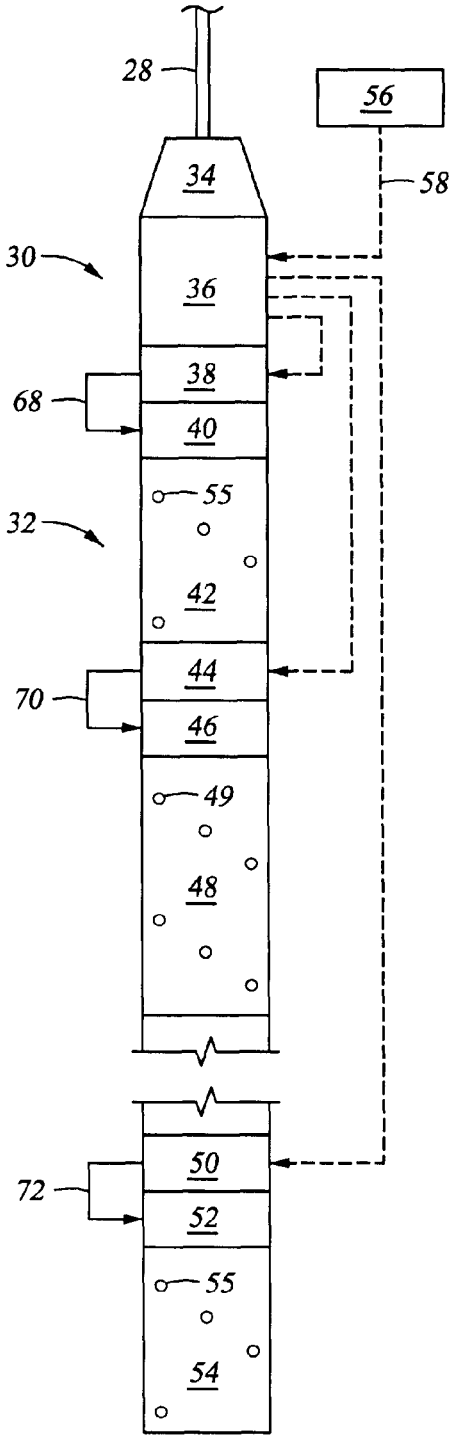
FIGS. 3 and 3*a* are schematic views of a perforating system of the present disclosure.

FIG. 3 provides a schematical view of an embodiment of a perforating system 30. The perforating system comprises a perforating string 32 disposable within a wellbore on a conveyance member 28. The conveyance member may be a wireline, a slickline, tubing, coiled tubing, and any other know or later developed means for deploying perforating systems within a wellbore.

A head 34 is located at the uppermost portion of the perforating string 32 and coupled to the conveyance member 28. The head may be used to electrically connect the perforating system to the conveyance member 28. It provides both mechanical and electrical attachment for conveying signals from the conveyance member 28 to the perforating string 32. In addition to providing electrical and/or mechanical connectivity between the conveyance member 28 and the perforating string 32, the head 34 may also be configured as a frangible link that may be broken with excessive tension applied to the conveyance member 28.

Disposed on the perforating string 32 adjacent the head 34 is a communication module 36. As will be described in more detail below, the communication module 36 is configured to receive a signal, represented by arrow 58, from surface and transmit that signal to the remaining portions of the perforating string. Arrows (60, 62, 64) represent communication from the communication module 36 to different components within the perforating string 32. The communication between the communication module and the other portions of the perforating string may be coded so that specific operations may be selectively undertaken by the perforating system 30.

A controller 38 is included with the embodiment of the perforating string 32 of FIG. 3. The controller 38 is shown in data communication with the communication module 36 by the arrow 60. The arrow 60 illustrates a command path emanating from the communication module 36 being received by the controller 38. The controller 38 includes means for receiving the signal 60 and processing means for processing data embedded within the signal. The processor can be programmed to undertake a particular action accordingly based upon the content of the data signal 60. For example if it receives a data signal representative of a command to initiate an operation of a perforating gun, a corresponding data detonation signal may be generated by the processor and then forwarded to an associated firing head. The corresponding data signal is represented by arrows 68, 70, and 72.

Firing head 40 is coupled and associated with a perforating gun 42, wherein the perforating gun has shaped charges 43. The perforating string 32 includes additional sets of controllers (44, 50), firing heads (46, 52), and perforating guns (48, 54) with shaped charges (49, 55). In the embodiment shown, the controller 44 is associated with firing head 46 and perforating gun 48; the controller 50 is associated with firing head 52 and perforating gun 54. It should be pointed out however that the perforating string 32 may be comprised of a single perforating gun, or a perforating string with a multiplicity of perforating guns that may exceed thousands feet in length.

In one mode of operation, perforating gun detonation may be commenced by sending a signal from a surface controller 56 to the communication module 36. Although the arrow 58 is shown external to the perforating string 32, the arrow 58 is representative of data, signal, or command communication between the surface controller 56 and the communication module 36. Optionally, communication could be transmitted in any number of ways, such as along the conveyance member 28, as well as other known and later developed methods of transferring the signal from the surface controller 56 to the communication module 36

Based upon the data signal represented by arrow 58, the communication module 36 may then send a corresponding detonation initiation signal to one of the firing heads, selected firing heads, or all firing heads simultaneously. The signal, which is preferably wireless, may consist of many different forms. The signal may comprise a mud pulse, a radio frequency signal, a high frequency signal as well as a low frequency signal. The low frequency signal may be transmitted through the body of the tool, the wellbore mud, as well as the casing. As noted above, each of the firing heads, will include a receiver and processing device capable of receiving the signal and then decoding the signal to determine whether or not action should be taken by the firing head.

Along with the processor, a program memory will be accessible to compare the signal received with pre-encoded instructions so the processor includes the capability of taking a particular action based upon the data received from the controller 38. Although shown as separate modules, the controller (38, 44, 50) may be combined with the respective firing heads (40, 46, 52). Accordingly, a single module would have the capability of receiving a data signal, decoding a data signal, and firing the associated perforating gun. Arrows 68, 70, and 72 represent a data command emanating from the controller to its associated firing head.

The perforating system 30 discussed herein includes many advantages over prior art perforating systems. For example, known systems are typically configured to detonate the entire string in a sequence from the top portion of the string to the lower portion. The individual modular configuration of the perforating string 32 of FIG. 3 provides the capability of selectively initiating a single perforating gun, or a collection of one or more perforating guns within the string. In some situations, it might be desired to initiate one or more of the perforating guns, reposition the perforating system 32 within an associated wellbore, and then send another command from the surface controller 56 to the communication module 36 for the detonation of one or more other selected perforating guns.

Figure 3A:
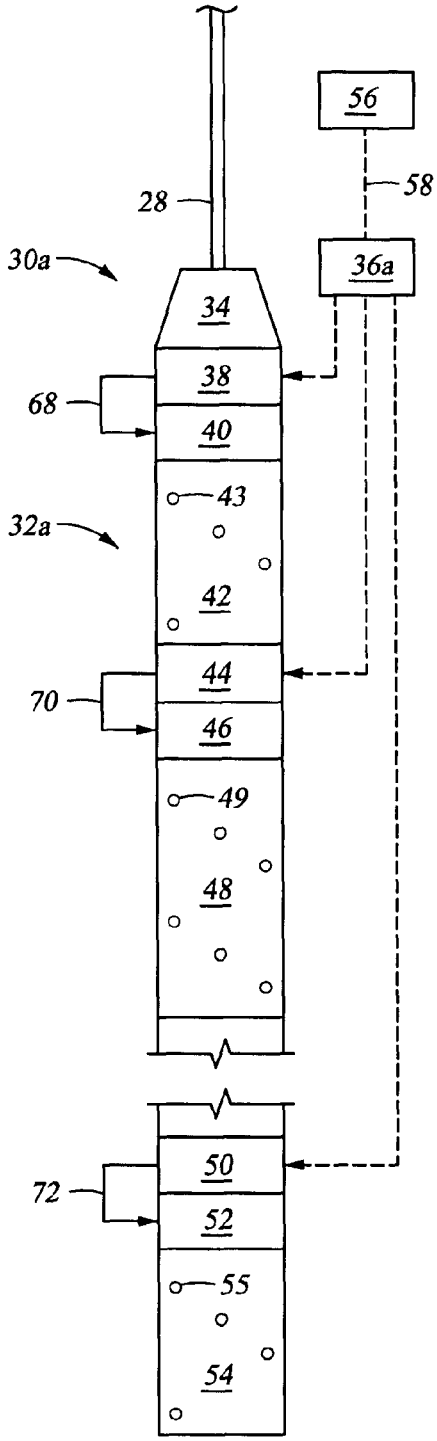

FIG. 3*a* illustrates schematic view of an optional embodiment of a perforating system 30*a* where the communication module 36a is not mechanically attached to the perforating string 32*a* . In the embodiment of FIG. 3*a* the communication module 36*a* communicates with controllers (38, 44, 50) via wireless communications (represented by dashed lines with arrows) through means of the wellbore.

Figure 4:
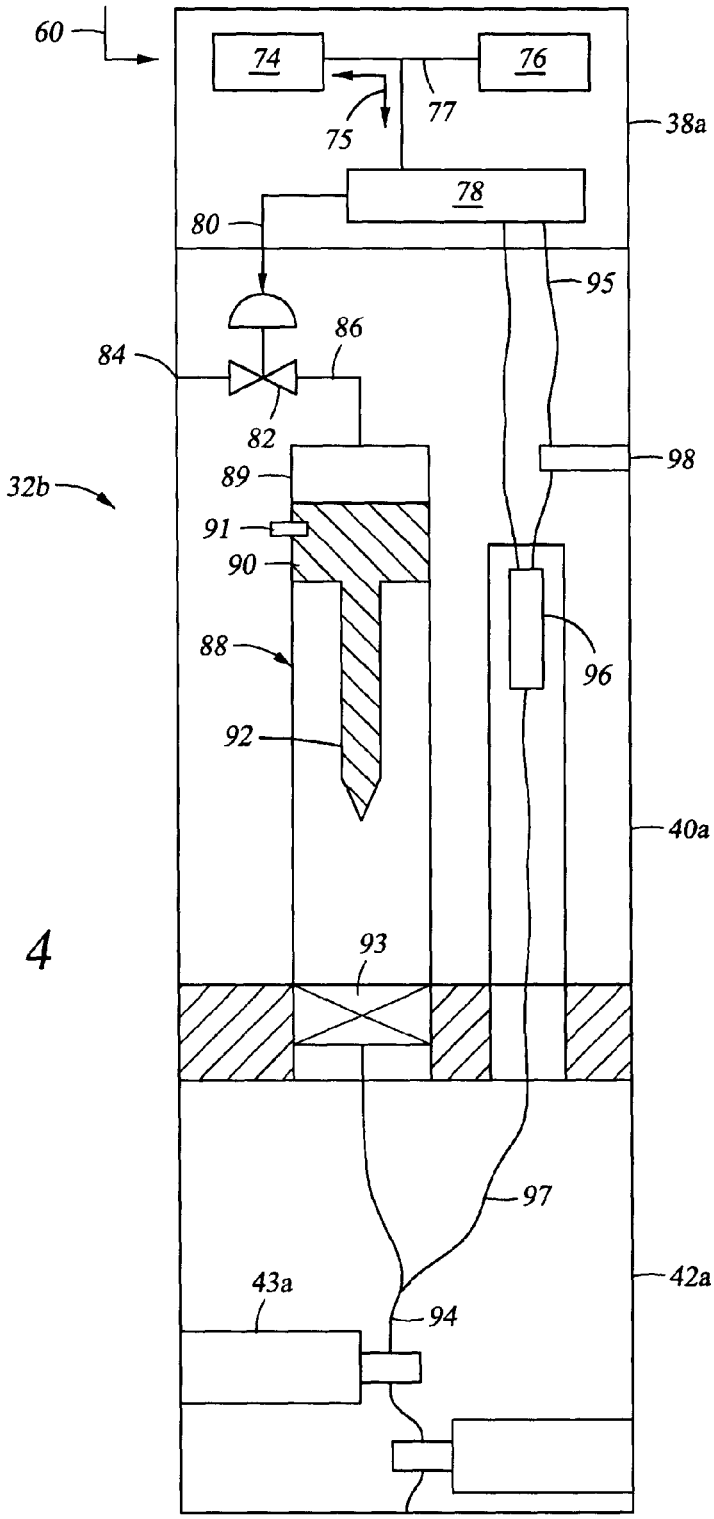
FIG. 4 is a side schematic view of a controller and initiator of a perforating gun.

With reference now to FIG. 4, another alternative example of a portion of a perforating string 32*b* is shown. In this embodiment, the portion of the perforating string 32*b* comprises a controller 38*a*, a firing head 40*a*, and an associated perforating gun 42*a*. Controller module 38*a* includes a receiver 74 and a controller module 78. In some instances the receiver 74 may also operate as a transmitter. The receiver 74 and controller module 78 may each receive power by an associated battery 76. A communication link 75 illustrates communication between the receiver and a controller module. Wire 77 provides electrical communication for electrical connectivity between the battery 76 and receiver 74 and controller 78.

Firing head section 40*a* includes a valve 82 selectively opened or closed by a control module. Also includes is an inlet line 84 providing pressure communication to the inlet of the valve 82 and the outside of the firing head 40*a*. Thus, the inlet to the valve 82 will be subject to wellbore pressure when the perforating system 32*b* is disposed in wellbore fluid. An exit line 86 downstream of the control valve 82 terminates in an initiator 88 therefore providing pressure communication downstream of the valve 82 and the initiator 88. The initiator 88 comprises a cylinder 89 having disposed therein a piston 90 and hammer 92; the hammer 92 extends downward from the piston 90. The cylinder 89, having a largely cylindrical opening, with the piston 90 correspondingly formed to axially move within the cylinder 89. The interface between the outer radius of the piston 90 and the inner circumference of the cylinder 89 should form a seal.

A shear pin 91 is shown extending through the wall of the cylinder 89 and into a recess formed in the piston 90. The shear pin 91 is included to prevent unwanted movement of the piston 90 within the cylinder 89. However, the shear pin 91 may be made of a soft polymeric material easily sheared upon being subject to relatively low pressure differential across the respective sides of the piston 90. Also disposed in the cylinder 89 is a pressure detonator 93 having a detonation cord connected on its lower end. The detonation cord 94 extends from the firing head 40*a* and into the associated perforating gun 42*a*. As is known, initiation of the detonation cord 94 in turn will produce a detonation wave traveling along the detonation cord 94 for initiating detonation of the shaped charges 43*a* connected to the detonating cord 94.

An optional detonator 96 is also shown within the firing head 40*a*. The optional detonator is connected to the controller module 78 by wire 95, with a pressure activated safety switch 98, and on its opposite end has a detonation cord 97 that connects to the primary detonation cord 94.

In one mode of operation of the perforating string segment 32*a* of FIG. 4, a detonation signal is delivered to the controller 38*a* via signal arrow 60. A receiver 74, which is configured to receive and decode the content of the signal 60, receives the signal, decodes it, and forwards its content to the controller module 78. Although shown as separate devices, the receiver 74 and controller module 78 may be integrated within a single module such as a processor, printed circuit board, or an information handling system. As with the other controllers discussed above, the controller module 78 is programmed to take action depending upon the content of the signal 60. In situations where the signal content includes a detonation command, a corresponding detonation signal, represented by arrow 80, is forwarded to the control valve 82. The control valve, which includes an actuator, may be opened thereby providing pressure communication through the inlet line 84 and exit line 86 into the cylinder 89. The pressure communication, typically in the form of wellbore fluid flowing into a cylinder, exceeds the ambient pressure within the cylinder 89. This in turn forces the piston 90 out of its seat by shearing the shear pin 91 and propels the piston 90 and hammer 92 downward into striking contact with the detonator 93. The sharpened point of the hammer 92 will have sufficient percussion to cause ignition of the detonator 93 in order to produce a corresponding detonation in the detonation cord 94 for detonating the shaped charges 43*a*. Accordingly, one of the advantages of using the combination of controller module 38*a* and firing head 40*a* for pressure based initiation is that the perforating string 32 is not subject to a premature detonation based on an errant electrical signal. That is because the perforating string would be detonatable only by the presence of wellbore pressure. As such, detonation of these perforating guns would not occur accidentally prior to being inserted within the wellbore.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the invention described herein is applicable to any shaped charge phasing as well as any density of shaped charge. Moreover, the invention can be utilized with any size of perforating gun and any type of perforating element and as such is not limited to shaped charges as a perforating element. These and other similar modifications will readily suggest themselves to those skilled in the art, and are intended to be encompassed within the spirit of the present invention disclosed herein and the scope of the appended claims.

What is claimed is:

1. A method of perforating a wellbore comprising:

providing a communication module, a string of perforating guns, and a controller associated with each perforating gun in the string;

disposing the communication module, string of perforating guns, and controllers in the wellbore;

communicating wirelessly between at least one of the controllers and the communication module along a path bypassing at least one of the other controllers and any device associated with the at least one of the other controllers; and selectively detonating at least one perforating gun by sending a detonation signal to the controller associated with the at least one perforating gun.

2. The method of perforating a wellbore of claim 1, wherein the perforating string further comprises a firing head.

3. The method of perforating a wellbore of claim 1, wherein the controller comprises a receiver, a transmitter, battery, and a control module.

4. The method of perforating a wellbore of claim 1 wherein the detonation signal is transmitted from the surface through a conveyance member attached to the perforating string.

5. The method of perforating a wellbore of claim 1, wherein the detonator signal originates from the communication module.

6. The method of perforating a well of claim 1 where in the communication module is attached to the conveyance member.

7. The method of perforating a well of claim 1 where in the communication module is detached to the conveyance member.

8. The method of perforating a wellbore of claim 1, wherein the perforating gun detonation is initiated by a pressure source.

9. The method of claim 8, wherein the pressure source comprises wellbore fluid.

10. The method of claim 1, wherein the receiver initiates perforating gun detonation by introducing wellbore pressure communication to an initiating system associated with the perforating gun.

11. The method of claim 10, wherein allowing wellbore pressure communication comprises opening a valve separating wellbore fluid pressure and the initiating system.

12. The method of claim 10, wherein the initiating system comprises a hammer configured to strike an initiator when exposed to pressure.

13. The method of claim 12, wherein the pressure comprises wellbore fluid pressure.

14. The method of claim 1, wherein the at least one perforating gun is a first perforating gun, the method further comprising repositioning the string of perforating guns within the wellbore; and sending another detonation signal for the detonation of a second perforating gun that is lower in the string than the first perforating gun.

15. The method of claim 1 wherein the step of communicating wirelessly includes sending a signal selected from the list consisting of a mud pulse, a radio signal, a high frequency signal, a low frequency signal, and combinations thereof.

16. The method of claim 1, wherein each perforating gun includes a body, and the step of communicating wirelessly between the controllers and the communication module comprises transmitting a signal through each body.

17. The method of claim 1, wherein the path is distinct from paths along which other controllers communicate with the command module.

18. A perforating system disposable in a wellbore comprising:

perforating guns;

a communication module; and controllers associated with each perforating gun and each controller in selective communication with the communication module, so that when communication between a controller and the communications module occurs, the communication follows a path direct from the communications module and the controller that bypasses other controllers and hardware associated with the other controllers.

19. The perforating system of claim 18, wherein at least one of the perforating gun controllers is configured to initiate perforating gun detonation in response to communication from the communication module.

20. The perforating system of claim 18, wherein at least one of the perforating gun controllers includes a controller module and a receiver.

21. The perforating system of claim 18, further comprising a perforating gun initiator.

22. The perforating system of claim 21, wherein the initiator is responsive to commands from the perforating gun controller.

23. The perforating system of claim 21, wherein the initiator is pressure actuated.

24. The perforating system of claim 23, further comprising a control valve actuatable by the controller and in pressure communication with the wellbore and the initiator.

25. The perforating system of claim 24, wherein the control valve selectively communicates wellbore pressure to the initiator.

26. The perforating system of claim 18, wherein the communication module is configured to emit signals selected from the list consisting of a mud pulse signal, a radio signal, a high frequency signal, a low frequency signal, and combinations thereof.

27. The perforating system of claim 18 further comprising a conveyance member.

28. The perforating system of claim 27, wherein the conveyance member is selected from the list consisting of a wireline, tubing, coiled tubing, and a slickline.

29. A method of wellbore perforating comprising:

providing in a wellbore a string of perforating guns having shaped charges, a communication module, and perforating gun controllers;

transmitting a first signal to the communication module;

based on the content of the first signal, wirelessly transmitting a second signal from the communication module to at least one of the controllers and along a path that bypasses another controller and any devices associated with the another controller; and initiating shaped charge detonation within a selected perforating gun based on the wirelessly transmitted second signal.

30. The method of wellbore perforating of claim 29, wherein the wireless second signal is selected from the list consisting of a mud pulse, a radio signal, a high frequency signal, a low frequency signal, and combinations thereof.

31. The method of wellbore perforating of claim 29 further comprising communicating wellbore pressure to a pressure activated shaped charge initiator.

* * * * *